United States Patent [19]

Yano

[11] Patent Number: 4,892,228

[45] Date of Patent: Jan. 9, 1990

[54] TOY WATER GUN

[75] Inventor: Hiroshi Yano, Moriguchi, Japan

[73] Assignee: Sekiden Co., Ltd., Osaka, Japan

[21] Appl. No.: 226,082

[22] Filed: Jul. 29, 1988

Related U.S. Application Data

[63] Continuation of Ser. No. 636,243, Jul. 31, 1984, Pat. No. 4,784,293.

[30] Foreign Application Priority Data

Aug. 3, 1983 [JP] Japan ..... 58-142010

[51] Int. Cl.[4] ..... F41B 9/00

[52] U.S. Cl. ..... 222/79; 222/380; 222/381; 222/382; 222/464; 239/331; 239/571

[58] Field of Search ..... 222/78, 79, 383, 385, 222/175, 372, 380–382; 239/331, 333, 570, 571; 446/473, 475

[56] References Cited

U.S. PATENT DOCUMENTS 4,056,216 11/1977 Kotuby ..... 222/385
4,325,501 4/1982 Shay ..... 222/383 X
4,591,077 5/1986 Corsette ..... 222/383 X

FOREIGN PATENT DOCUMENTS 2098078 11/1982 United Kingdom .

*Primary Examiner*—Kevin P. Shaver
*Attorney, Agent, or Firm*—Wenderoth, Lind & Ponack

[57] ABSTRACT

A toy gun for projecting a fluent material. The gun has a front gun body and a hollow rear gun body, one having a cylinder as a part thereof and the other having a piston as a part thereof, the piston being slidable in the cylinder for a distance greater than the finger barrel of a user. A handle is provided on each of the gun bodies projecting laterally thereof for gripping the bodies for relatively moving them for moving the piston back and forth in the cylinder. An improved nozzle is provided on the piston or cylinder on the front gun body. An improved first one-way valve is connected to the nozzle for closing when the gun bodies are moved relative to each other for moving the piston out of the cylinder, and an improved second one-way valve is provided on the piston or cylinder on the rear gun body for closing when the gun bodies are moved relative to each other for moving the piston into the cylinder. A fluent material conduit is connected to the second one-way valve from within the rear gun body and this conduit has the rear end held in a lowered position to insure flow of fluent material into the cylinder.

2 Claims, 4 Drawing Sheets

*Fig.* 11
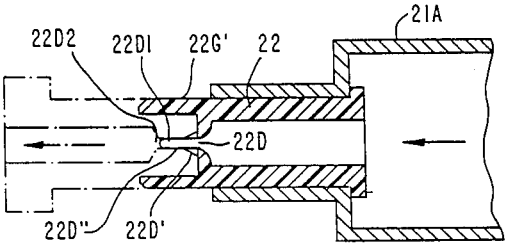

TOY WATER GUN

This application is a continuation of application Ser. No. 06/636,243 filed July 31, 1984 now U.S. Pat. No. 4,784,293.

FIELD OF THE INVENTION

The present invention relates to an improved projectile discharging toy gun, and more particularly to a toy gun for discharging a massive quantity of fluent material such as water, air, balls, or other projectile by the movement of the both hands which hold grips on the gun body, and whereby the duration of the projectile discharging operation of the gun body can be freely controlled so as to be long or short as desired. The invention of the present application is in an improved non-return valve means whereby the fluent material flow to and out of the nozzle means of the toy gun is controlled.

DESCRIPTION OF THE PRIOR ART

There are prior art rifle-style toy water guns. Most of them, however, have a projectile discharging cylinder near the center of the gun body and the front portion of the piston device extends forwardly therefrom. A cylindrical lateral bar on the forwardly extending part of the piston is provided for holding the front part of the gun body with one hand as well as for sliding the piston in the direction of the length of the barrel for carrying out a discharging operation.

Further, in such rifle-style toy water guns the discharging cylinder is fixed at the center of the gun body, and the nozzle is not provided directly on the discharging cylinder or the piston device. Rather the projectile is fed through a long, narrow pipe extending from the discharging cylinder to the front portion of the gun and the projectile is discharged from the nozzle which is at the front end of the gun.

SUMMARY OF THE INVENTION

The main object of the present invention is to provide a fluent material discharging toy gun with which even a young infant of two years old or so can play, which is capable of discharging an amount of fluent material ranging from a maximum to a minimum per unit time and over a long distance by minimizing the loss of the pressure used for discharge by placing the cylinder and piston at the front end of the projectile discharging toy gun, which enables the user to enjoy various ways of discharging projectiles by sliding the gun body back and forth freely or rotating it around the barrel, and which has non-return valve means for insuring good filling of the fluent material projecting portion of the toy gun.

With the above objects in view as may hereafter more fully appear from a study of the following specification and the annexed drawings, the invention consists of the novel constructions and combination of elements defining the toy gun, but it is to be understood that changes and modifications may be resorted to coming with the purview of the claims without departing from the spirit and nature of the invention.

BRIEF DESCRIPTION OF THE DRAWINGS

FIG. 11 is a partial sectional view of a modified form of the nozzle.

DETAILED DESCRIPTION OF THE INVENTION

Figure 1:
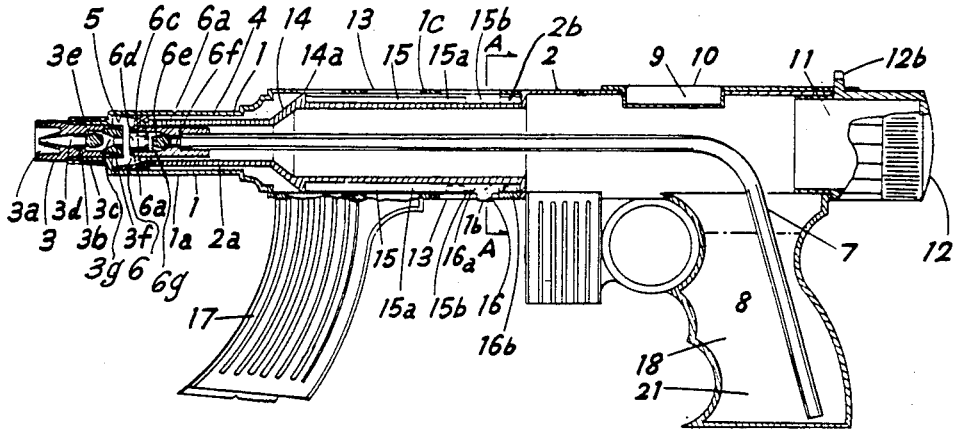
Fig. 1 (PRIOR ART)
FIG. 1 is a sectional side view of a toy gun according to the invention.

In the prior art toy guns, generally speaking, it has been a common practice to provide means which move through a stroke for projecting fluent material which can be operated by a single finger pulling a trigger. The trigger is normally movable through the same stroke as the means for projecting the fluent material, and because the finger and the trigger can move through a relatively short stroke, the stroke of the means for projecting the fluent material has been relatively short.

The present invention has provided a structure by which the length of stroke of the means for propelling the fluent material is independent of any stroke of a trigger.

Turning to the drawings, the toy gun of the present invention has a gun body divided into two parts, a front gun body 1 and a rear gun body 2. The front gun body of rigid material has a gun barrel 1*a* with a cylinder means 4 extending rearwardly from the front end thereof, and a guide means 1*c* in the form of a cylindrical chamber extending rearwardly from the cylinder means 4. The rear gun body has mounted thereon a piston means in the form of a piston 5 which is slidable in the cylinder means 4, so that the rear gun body and front gun body are relatively slidable back and forth in the direction of the movement of the piston 5 within the cylinder means 4.

A nozzle means 3 including a one-way or check valve means is provided on the front end of the front gun body 1, and has a nozzle member 3*a* opening out of the front thereof, to which a bore 3*d* extends from within the nozzle. The bore 3*d* has a front valve stop 3*b* therein, with a projection 3*c* extending rearwardly therefrom into a hollow chamber 3*g* within the nozzle means. The hollow chamber 3*g* opens rearwardly of the nozzle through an opening 3*f*, and within the chamber is a check valve body 3*e*, which, when in the forward position seats on the projection 3*c* to leave a passage thereby for the flow of the fluent material through the nozzle, and in the rearward position seats in a valve seat around the opening 3*f* for blocking flow of air rearwardly into the cylinder means 4. The piston 5 is mounted on the rear gun body 2 on the forward end of a barrel 2*a*, which is joined to a guide portion 15 by a generally conical gun body forward movement stop 14. At the forward end of the barrel portion 2*a* is a one-way or check valve means in the form of a check valve 6 which has a body member 6*a* with a forwardly extending opening 6*d* therein, a projection 6*c* extending rearwardly therefrom into a space 6*g* within the check valve 6, a rearwardly extending opening 6*f*, and a valve member 6*e* within the space 6*g* within the valve. In the rearward position, as shown in the drawing, the valve member 6*e* seats in a seat around the opening 6*f* to prevent rearward flow of fluent material as the piston moves forwardly, and in the forward position, it engages the projection, so as to leave a space through which the fluent material can flow through the opening 6*d*.

Inserted into a recess in the rear of the body 6*a* of the check valve 6 is a fluent material tube 7 which extends rearwardly through the rear gun body 2 into a storage space 8, for example in a grip or handle 18 on the lower portion of the rear gun body 2.

Figure 4:
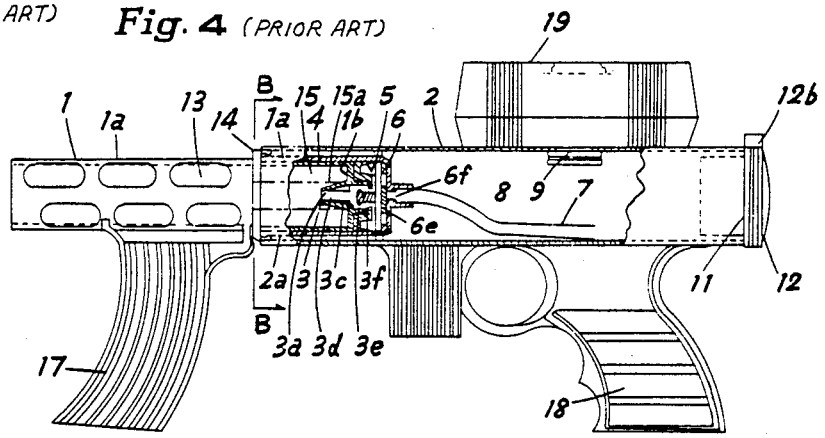
Fig. 4 (PRIOR ART)
FIG. 4 is a sectional side view of a modified embodiment of a toy gun according to the invention.
Figure 6:
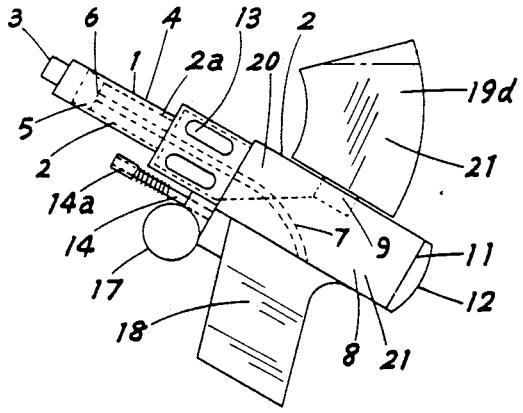
Fig. 6 (PRIOR ART)
FIG. 6 is a schematic side view of a toy gun of FIG. 8 in a position for discharging obliquely upward.
Figure 7:
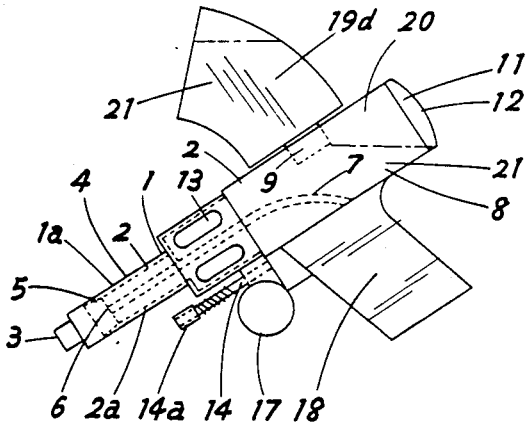
Fig. 7 (PRIOR ART)
FIG. 7 is a schematic side view of a toy gun of FIG. 8 in a position for discharging obliquely downward.
Figure 8:
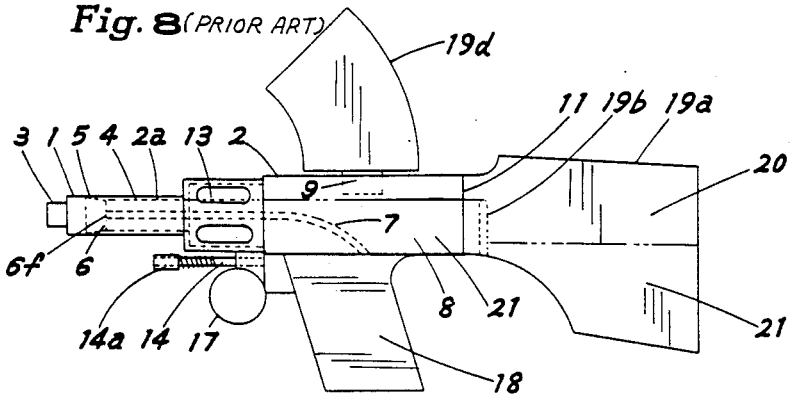
Fig. 8 (PRIOR ART)
FIG. 8 is a schematic sectional side view of another embodiment of a toy gun according to the invention.

Openings 13 are provided in the wall of the guide means 1*c* around the rearwardly extending cylindrical guide portion 15, and the rear gun body has a forwardly facing surface 2*b* against which the rear end of guide means 1*c* abuts in the rearward most position of front gun body 2 on the rear gun body 2, as shown in FIG. 1. To the rear of the surface 2*b* is an upper opening 9 in the rear gun body 2 which is normally closed by a lid 10. The lid 10 can be replaced by a magazine-shaped fluent material storage chamber 19, as shown in FIG. 4, or 19*d* as shown in FIGS. 6–8, which can hold additional fluent material. The rear opening 11 of the rear gun body is closed by a lid 12 which has a gun sight 12*b* thereon.

The guide portion 15 has ribs 15*a* extending longitudinally thereof and spaced at intervals around the circumference thereof, and which slidably engage the guide surface of the guide means 1*c*, and these ribs 15*a* terminate short of the rear end of the guide portion 15 to leave a gap 15*b*. At the rear end of the barrel 1*a* of the front gun body 1 is a stop 1*b* which projects into the gun barrel, and has forwardly and rearwardly extending leg portions 16*a* and 16*b* of about the same length as the gap 15*b*. The total length of the leg portions and the stop is slightly greater than the length of the gap 15*b*. Depending from the barrel of the front gun body is a front gun body grip or handle 17.

It will thus be seen that the front and rear gun bodies are slidable relative to each other in the direction toward and away from each other, the piston 5 sliding in the cylinder means 4, and in its rearward movement closing the front check valve and allowing the rear check valve to open, thus drawing fluent material through the supply pipe 7 past the rear check valve into the space within the cylindrical means 4 ahead of the piston 5. When the parts are moved relatively toward each other, the piston 5 slides relatively forwardly in the cylinder means 4, and the rear check valve closes, the valve body 6*e* seating on the valve seat around the opening 6*a*, and the forward check valve opens, the valve body 3*e* seating on the projection 3*c*, so that fluent material in the cylinder means 4 is projected forwardly through the front check valve to be projected from the nozzle 3. The length of the stroke is limited only by the length of the cylindrical means and the stroke of the piston therein. This is independent of the movement of a finger of the user.

The parts are moved relative to each other by the user gripping the handle 18 in one hand and the handle 17 in the other hand, and moving the hands toward or away from each other. Because the stroke can be made long, the length of the cylinder portion can be made about 100 to 200 mm, so that the fluent material 21 from the storage space 8, such as water, can be projected great distances by rapid movement of the gun bodies 1 and 2 toward each other through the full stroke.

It will be seen that because the handle 17 is on the outside of the barrel of the front gun body, the piston 5 and the cylindrical means 4 and the guide portion 15 on which it is mounted can be moved freely into the front gun body without interference from the handle 17. Thus the range of the movement of the piston within the cylinder means can be rather great, and the actual stroke can be freely chosen by the operator to be the full length of the relative movement or anything less.

The forward movement stop 14 is a conical portion joining the forward end of the rear gun body and the guide portion 15 projects slightly radially outwardly of the guide portion 15 to form a stop member 14*a*, which, when the forward gun body is moved to the full forward extent, is engaged by the stop 1*b* for blocking further forward movement. The stop member 14*a* has a cut 14*b* therein (see FIG. 3) preferably at the top part thereof, through which the stop 1*b* can be passed when the front body portion is moved onto the rear body portion during assembly of the toy gun. Only deliberate manipulation by relative rotation of the front and rear gun body parts and then relative movement away from each other with the parts in the proper relatively rotated position can cause the front gun body to be moved off the rear gun body. The cut 14*b* can be slanted relative to the longitudinal axis of the gun bodies. Thus, small children can play with the gun, and not unintentionally cause the front and rear gun bodies to separate.

Figure 2:
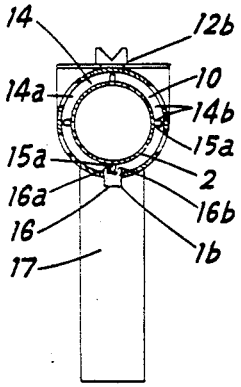
Fig. 2 (PRIOR ART)
FIG. 2 is a sectional view taken along line A—A of FIG. 1.

The provision of the gaps 15*b* at the rear ends of the rigs 15*a* permits the front and rear gun bodies 1 and 2 to be rotated relative to each other when the rear gun body is inserted fully into the front gun body, so that the stop 1*b* is circumferentially aligned with the gaps 15*b*. Thus, the person playing with the gun can hold the handle 17 and handle 18 aligned, or can have them circumferentially offset. The stop member 1*b* has a groove in the upper surface thereof, in which a rib 15*a* can engage for causing the front and rear gun bodies to move linearly toward and away from each other, as shown in FIG. 2. It will be understood, however, that the stop member 1*b* can also be caused to move into the circumferential space between the ribs, and the gun bodies can still be moved toward and away from each other, and also rotated relative to each other at the same time.

Figure 3:
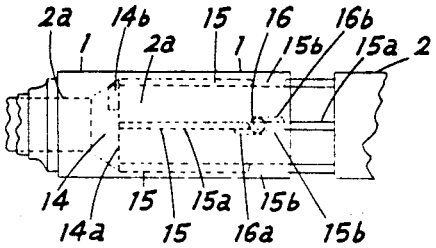
Fig. 3 (PRIOR ART)
FIG. 3 is a partial bottom view of the toy gun of FIG. 1 with the grip 17 removed.

The stop 1*b* can have a mounting guide device 16 thereon with the legs 16*a* and 16*b* extending relatively forwardly and rearwardly from the inner end of the stop body and spaced circumferentially on opposite sides of a gap corresponding to the width of a rib 15*a*, as shown in FIGS. 2 and 3. This makes it possible to relatively slide the parts smoothly through the gap 15*b*. In this case, the member 16 serves as the front gun body stop when it abuts the stop member 14*a*.

It will be seen that the handle 17 is shaped similar to a magazine, for simulating the appearance of a real gun.

The provision of the openings 13 in the cylindrical body 1 makes it possible to observe the relative movement of the gun bodies.

As can be seen from FIGS. 6–8, the hole 9 in the rear of the rear gun body 2, which is normaly closed by the lid 10, can be used to attach a further magazine 19*d*, which can have the shape of a real magazine, and can be used to store additional fluent material 21. In addition, or alternatively, the rear closure 12 for the rear opening 11 can be removed, and replaced with a gun-butt-shaped member **19*a* which can store still further fluent material 21. The supply pipe 7 can be caused to terminate in the rear cylindrical portion of the rear gun body 2, rather than extend down into the handle 18, and the handle 18 can be closed off, so that the fluent material is contained only in the magazine 19*d*, and/or the gun-butt-shaped container 19*a*. The gun can then be held in various positions, such as shown in FIGS. 6 and 7**, and the fluent material projected therefrom regardless of the angle of inclination of the gun.

A barrier **19*b* can be provided between the gun-butt-shaped container 19*a* and the remainder of the interior of the rear gun body, so as to control the flow of fluent material from the container 19*a* into the rear gun body 2**.

Figure 5:
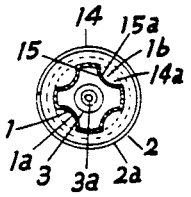
Fig. 5 (PRIOR ART)
FIG. 5 is a sectional view taken along line B—B of FIG. 4.

The embodiment of FIGS. 4 and 5 is generally the reverse of the embodiment of FIGS. 1–3, i.e. the cylinder means 4 is mounted on the inside of the front end of the rear gun body 2, and the front gun body 1 has the piston 5 thereon slidable in the cylinder means 4 of the rear gun body. The nozzle 3 is immediately in front of the piston 5, and the piston 5 has an aperture therethrough in which the nozzle 3 is incorporated. The rear one-way or check valve 6 is a simple valve plate which covers and uncovers the opening **6*f* in the rear end of the cylinder means 4. The stop 14 is mounted on the front of the rear gun body and is engaged by a stop 1*b* constituted by the forward face of the piston 5. The piston 5 and the front gun body 1 are generally cruciform in shape, and the barrel portion 1*a* is cylindrical and is around the main part of the gun body and has the openings 13** therein.

Figure 9:
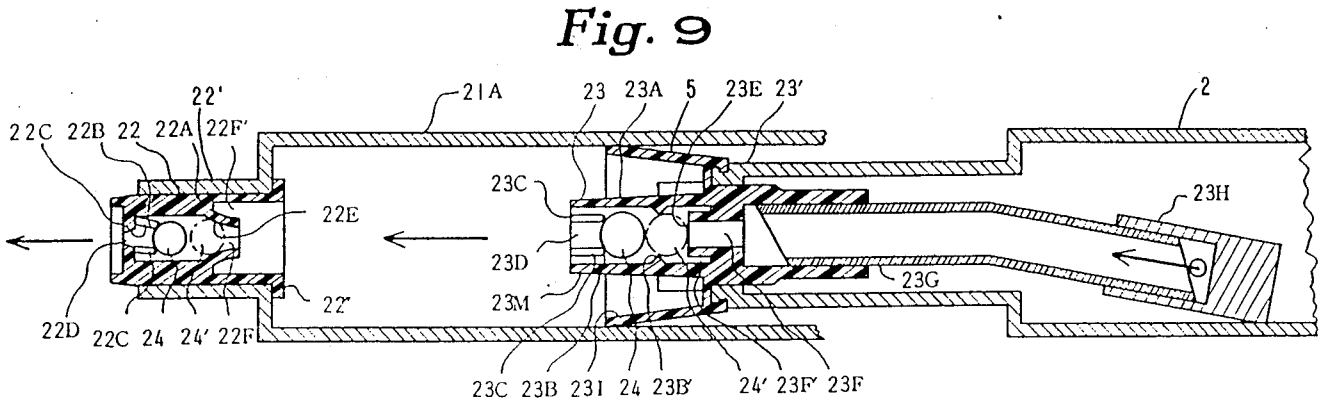
FIG. 9 is a longitudinal sectional elevation view through the front gun body gun barrel showing one embodiment of the non-return valves of the invention in the fluent material discharge position.
Figure 10:
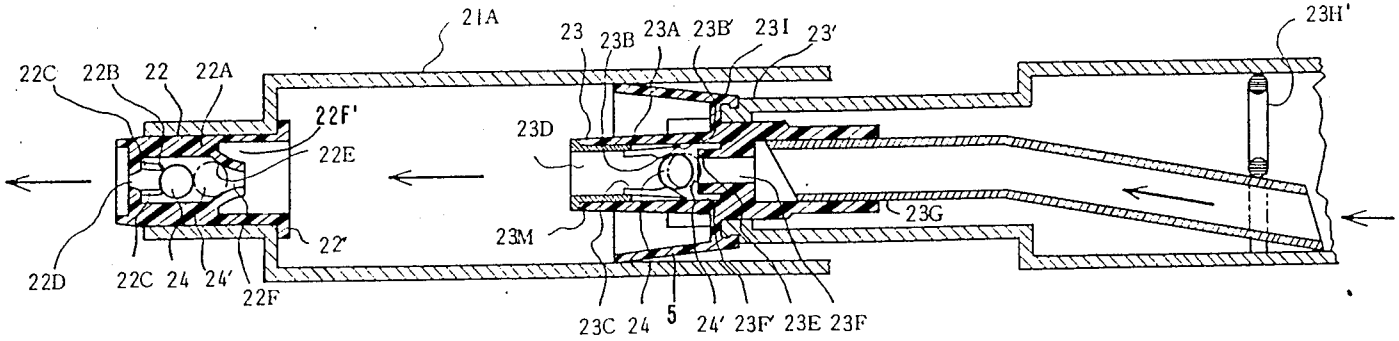
FIG. 10 is a view similar to FIG. 9 showing a modified form of the non-return valves.

As shown in FIGS. 9 and 10, the front gun body **1*a* has a cylinder 21A thereon with a one way valve mounting cylindrical projection 22' at the front end portion thereof, and the rear gun body 2 has a one way valve mounting cylindrical projection 23' provided thereon. The one way valves 22 and 23 have respective hollow cylindrical main bodies 22A and 23A, and on the inside of the forward portion of these bodies are ribs 22C and 23C spaced around the inner periphery thereof and extending forwardly in the direction of flow of the fluent material. The rear ends of the respective ribs 22C and 23C act as stops 22B and 23B for a valve body 24 in each of the valves. When the respective valve bodies engage the stops 22B and 23B, spaces are provided between the ribs for the flow of fluent material past the valve body and the ribs and out of the valve. Around the inner periphery of the main body 23A is a further stop member 23B' which has an inner diameter slightly less than the outer diameter of the valve body 24. A nozzle 22D and a bore 23D are provided in each of the respective valves within the ribs. At the rear of each of the respective main bodies 22A and 23A is a fluent material inlet 22F and 23F having a valve seat 22E and 23E around the forward end thereof against which the valve body 24 seats when it is in the rearward position shown at 24'. The rearwardly projecting portion 22F of the forward or front valve has around the outer periphery thereof a gap 22F' defined between the member 22F and the inner periphery of the body 22A. A similar gap 23F' is defined around the forward portion of the element 23F**. The respective main bodies as thus constructed are preferably molded of a soft elastic material such as polyethylene.

The forward end of the space within ribs 22C has a nozzle 22D formed therein for forming a jet of the fluent material being discharged.

When the piston moves forwardly, to the left in FIGS. 9 and 10, the forward end 23M of the rear one way valve main body 23A contacts the front valve 22, and this is urged forwardly by the rear main body 23A. The front valve 22 is kept from being pushed out of the cylindrical projection 22' by the flange 22'' around the rear end of the main body 22A, and which engages against the front wall of the cylinder 21A around the forwardly extending cylindrical projection 22' which houses the front one way valve 22.

A fluent material suction tube 23G extends rearwardly from the main body 23A and the fluent material inlet hole 23F. The main body 23A carries a forwardly flared gasket 23I which moves in sealing engagement along the interior of the cylinder 21A to cause the piston 5 to press fluent material within the cylinder 21A. This is tightly engaged with the cylindrical projection 23' on the piston 5.

The front of the main body 22A of the front one way valve 22 has the nozzle 22D integrally molded therewith. As shown in FIG. 11, the mold has a mold core 22D1 which extends into mold core 22D2 forms the nozzle 22D, and the arrangement is such as to form a reverse bellmouth-shaped projecting portion 22D' i.e. the rearwardly facing inner surface of the projecting portion 22D has a bellmouth shape, namely an outwardly flaring shape defining the nozzle 22D. A thin film 22D'' may be formed at the forward end of the projecting portion 22D' due to the wear and or looseness of the contact between the parts of the mold core.

This structure provides considerable advantage over the prior art valve means, in which the stops for the valve bodies, corresponding to the stops 22B and 23B of the present invention, are a separate part from the main body 22A and 23A. Thus, these parts must be inserted into the parts corresponding to the main bodies 22A and 23A, and good air tightness cannot be obtained. If the insertions become loose, they are apt to come out of the parts corresponding to the main bodies 22A and 23A, whereas if they are fitted too tightly into the main bodies, they are apt to be deformed. This makes it even more difficult to obtain satisfactory air tightness between the valve seats and the valve members.

The present invention overcomes this drawback by making the main bodies, the stops and the valve seats of the respective valves in a single piece, with the ribs 22C and 23C integral with the main bodies 22A and 23A, and by utilizing plastic material having elasticity for the valve seats, so that valve bodies will firmly seat against the valve seats 22F and 23F, and will firmly fit against the stops 22B and 23B without the stops coming loose or being distorted because they are fitted too tightly into the main bodies 22A and 23A.

The resiliency of the valve seats 22F and 23F is further enhanced by the provision of the recesses 22F' and 23F' around the outer periphery of these valve seats. The valve seats can thus give way and expand slightly under the force of the valve bodies 24 against the seats, so that the valve bodies 24 will seat firmly against the valve seats in the positions 24'. This improves the suction in the apparatus when the piston is being withdrawn, thus ensuring that fluent material will be drawn into the cylinder 21A as the piston is drawn backwardly, so as to completely fill the chamber. No suction is lost through improper seating of the valve 24 on the valve seat 22F. Likewise no leakage rearwardly past valve seat 23F will occur as the piston is moved forwardly.

The provision of the stops 23B' in the rear one way valve 23 prevents the valve body 24 thereof from moving forwardly too far when the pressure within the cylinder 21A ends at the end of the forward stroke of the piston. Thereafter, as the piston starts to be withdrawn, the suction pressure will force the valve body 24 past the stop 23B' into the position against the stops 23B. Leakage of fluent material is thus prevented, until the vacuum generated by the withdrawal of the piston causes the valve body 24 to move past the stop 23B' against the stops 23B to admit the fluent material through the valve 23 into the space within the cylinder 21A. The reverse takes place when the piston moves forwardly, i.e. the build-up of pressure on the valve body 24 moves it past the stop 23B' into firm engagement with the valve seat 23F, to block flow of fluent material back into the rear gun body.

The modified embodiment of FIG. 10 provides the valve stop 23B' in the form of an annular main body with forwardly projecting resilient legs with released tips at the main body of the stop 23B', and using the elasticity of said tips of the legs. The valve body 24 is supported and press-jointed to the bottom of the valve seat 23E by the increase and decrease of the fluent material pressure as it flows, and the forward and backward movements of the valve body 24 become possible by spreading or closing of said legs, and the valve body 24 is press-jointed and supported, and control of the fluent material flow becomes possible.

Because the ribs 22C and 23C are inclined to the direction of the flow of the fluent materials, the discharged fluent material can be given a rotating movement or it can be jetted out straight ahead.

As shown in FIG. 9, the rear end of the suction tube 23G can be held on the bottom of the rear gun body by a means such as the weight 23H, so that it will always be immersed in the fluent material in the rear gun body and thus fluent material will always be drawn forwardly during the withdrawal of the piston from the front gun body.

Alternatively, as shown in FIG. 10, the rear end of the suction tube 23G can be held down by means such as a hold-down member 23H, preferably in the form of a wire spring loop which is held between the upper portion of the rear gun body and the top of the suction tube 23G.

As described hereinbefore, the rear portion of the main body 22A of the forward valve 22 has a flange 22" thereon which fits firmly against the forward wall of the cylinder 21A, so that even though the valve 22 is subjected to high fluent material pressure as the piston is moving forwardly, it will still be held firmly in the forwardly projecting portion 22' of the front gun barrel. Further, this makes the assembly of the valve 22 into the front gun barrel easy. As a result, the production cost is reduced and the toy gun can be sold at a low price.

As can be seen from FIG. 11, the forwardly projecting pin 22D1 on the core for forming the main body 22A of the valve 22 projects into the receiving hole 22D2 in the forward mold piece, and if the fit is a tight fit, the forwardly projecting portion of the nozzle 22D will be formed without any thin film 22D" being produced due to the wear of the pin and the receiving hole over a long period of time. Even if such a thin film 22D" is produced, it extends parallel to the direction of the water flow, since the nozzle is in the shape of a reverse bell mouth, and therefore it will not hamper the discharge of the fluent material.

The forwardly extending cylindrical projection 22G' on the main body 22A surrounds the outwardly projecting portion of the reverse bellmouth nozzle 22A, and thus protects it from being damaged by contact with other objects. Therefore, the discharge of fluent material can be maintained and will be stable for a long period of time.

I claim:

1. In a toy gun for projecting a fluent material and having a front gun body and a hollow rear gun body of rigid material, one having a cylinder means as a part thereof and the other having a piston means as a part thereof, said piston means being slidable in said cylinder means for permitting movement of the gun bodies toward and away from each other, spaced apart grip means on the respective gun bodies projecting laterally thereof for gripping said bodies for relatively moving them for moving said piston means back and forth in said cylinder means, guide means on one of said gun bodies slidable along the other of said gun bodies for guiding said gun bodies in the direction of the longitudinal axes of said piston and cylinder means, stop means on the other of said gun bodies along the path of movement of the one body and the guide means and being engageable with the stop means when the gun bodies are substantially at the end of the movement of the gun bodies away from each other for preventing the gun bodies from coming apart, and nozzle means on the one of said piston means and cylinder means which is forwardmost, an improved valve means comprising:

a first one way valve means connected to said nozzle means on the forwardmost of said piston means and cylinder means and having a first hollow main body of soft elastic material with a nozzle integrally formed on the front end thereof and having a smooth conical shape converging forwardly of said main body, with a valve stop within said first hollow main body around said nozzle, with a first valve seat integrally formed on the rear end thereof having a first flow passage therethrough having a wall with a rearwardly converging smooth conical shape, and with a first valve body within said first hollow main body movable against said conical shape wall during movement of said piston means and said cylinder means away from each other and movable away from said first valve seat and against said valve stop during movement of said piston means and cylinder means toward each other; and a second one way valve means on the one of said piston means and cylinder means which is rearmost and having a second hollow main body of soft elastic material with a second flow passage at the forward end thereof, with a furter valve stop within said second hollow main body around said second flow passage, with a second valve seat integrally formed on the rear end thereof having a further flow passage therethrough, and with a second valve body within said second hollow main body and movable against said second valve seat during movement of said piston means and said cylinder means toward each other and movable away from said second valve seat and against said further valve stop during movement of said piston means and said cylinder means away from each other.

2. An improved valve means as claimed in claim 1 in which said first valve seat has a recess therearound into which said first valve seat can expand when the first valve body moves against said first valve seat during movement of said piston means and said cylinder away from each other, and said second valve seat has a recess therearound into which said second valve seat can expand when said second valve body moves against said second valve seat during movement of said piston means and said cylinder toward each other.

* * * * *